US007228765B1

(12) United States Patent
Wu

(10) Patent No.: US 7,228,765 B1
(45) Date of Patent: Jun. 12, 2007

(54) ADJUSTABLE WRENCH

(75) Inventor: Arthur Wu, Taichung Hsien (TW)

(73) Assignee: Proxene Tools Co., Ltd., Shekou Village, Shen Kang Hsiang, Taichung (TW)

( * ) Notice: Subject to any disclaimer, the term of this patent is extended or adjusted under 35 U.S.C. 154(b) by 0 days.

(21) Appl. No.: 11/489,948

(22) Filed: Jul. 20, 2006

(51) Int. Cl.
*B25B 13/16* (2006.01)

(52) U.S. Cl. ..... 81/165; 81/170

(58) Field of Classification Search ..... 81/165, 81/186, 490, 170, 166, 167, 145, 146, 147
See application file for complete search history.

(56) References Cited

U.S. PATENT DOCUMENTS 6,484,610 B1 * 11/2002 Macor ..... 81/165
6,615,694 B1 * 9/2003 Macor ..... 81/165
7,096,767 B2 * 8/2006 Sherburne ..... 81/145
2006/0075853 A1 * 4/2006 Sherburne ..... 81/145

* cited by examiner

*Primary Examiner*—Jacob K. Ackun, Jr.

(57) ABSTRACT

An adjustable wrench comprises a handle, a head portion formed at one end of the handle, and an adjusting unit. The head portion further includes a fixed jaw and a movable jaw, which forms a clip surface for clipping a screwed part. The movable jaw is provided with a slide rod at a bottom side thereof that is retained along a slot extended transversely across the head portion. The adjusting unit controls the displacement of the movable jaw along the slot. The ratio of a maximal outer width to a maximal inner width is selected from three ranges so that the operation of the wrench within a limited space can be facilitated, attaining the goal of quickly loosening the screwed part.

3 Claims, 5 Drawing Sheets

ADJUSTABLE WRENCH

FIELD OF THE INVENTION

The present invention relates to hand-held tools, more particularly to an adjustable wrench capable of clipping screwed parts of various sizes by adjusting the clip size of its jaws.

BACKGROUND OF THE INVENTION

The adjustable wrench of the prior art disclosed in U.S. Pat. No. 6,615,694 comprises two jaws at the front end of the wrench having a shrinking opening for easy access to a screwed part in a tight space.

The adjustable wrench cited above of the prior art can be inserted into a limited space wherein a screwed part is located. However, there are two disadvantages. One is that the engagement between the jaws and the screwed part is usually partial, which is risky to a user and may damage the screwed part. The other is that the slide rod of the movable jaw may bulge out too much, therefore hindering the rotation of the wrench around the screwed part.

Further, the adjustable wrench disclosed in U.S. Pat. No. 6,484,610 by the same inventor has a specially designed percentage ratio of the outer width between the jaws to the clip size, wherein the jaws are better engaged with a screwed part in a limited space. But the angular rage per twist is still too small for efficient operation.

SUMMARY OF THE INVENTION

The primary objective of the present invention is to provide an adjustable wrench comprising a handle, a head portion formed at one end of the handle, and an adjusting unit. The head portion further includes a fixed jaw and a movable jaw, which forms a clip surface for clipping a screwed part. The movable jaw is provided with a slide rod at a bottom side thereof that is retained along a slot extended transversely across the head portion. The adjusting unit controls the displacement of the movable jaw along the slot. The ratio of a maximal outer width to a maximal inner width is selected from three ranges so that the operation of the wrench within a limited space can be facilitated, attaining the goal of quickly loosening the screwed part. The maximal outer width W0 is specifically defined by the distance between two imaginary parallel planes both perpendicular to said slot and respectively tangent to the most bulged point on said outer lateral wall of said fixed jaw and the outermost end of said slide rod of said movable jaw.

Accordingly, the ratio of the maximal outer width W0 to the maximal inner width W1 is selected from three ranges: (1) less than or equal to 210% and greater than or equal to 150%; (2) less than or equal to 200% and greater than or equal to 150%; and (3) less than or equal to 175% and greater than or equal to 150%.

The various objects and advantages of the present invention will be more readily understood from the following detailed description when read in conjunction with the appended drawings.

DETAILED DESCRIPTION OF THE PREFERRED EMBODIMENTS

Figure 1:
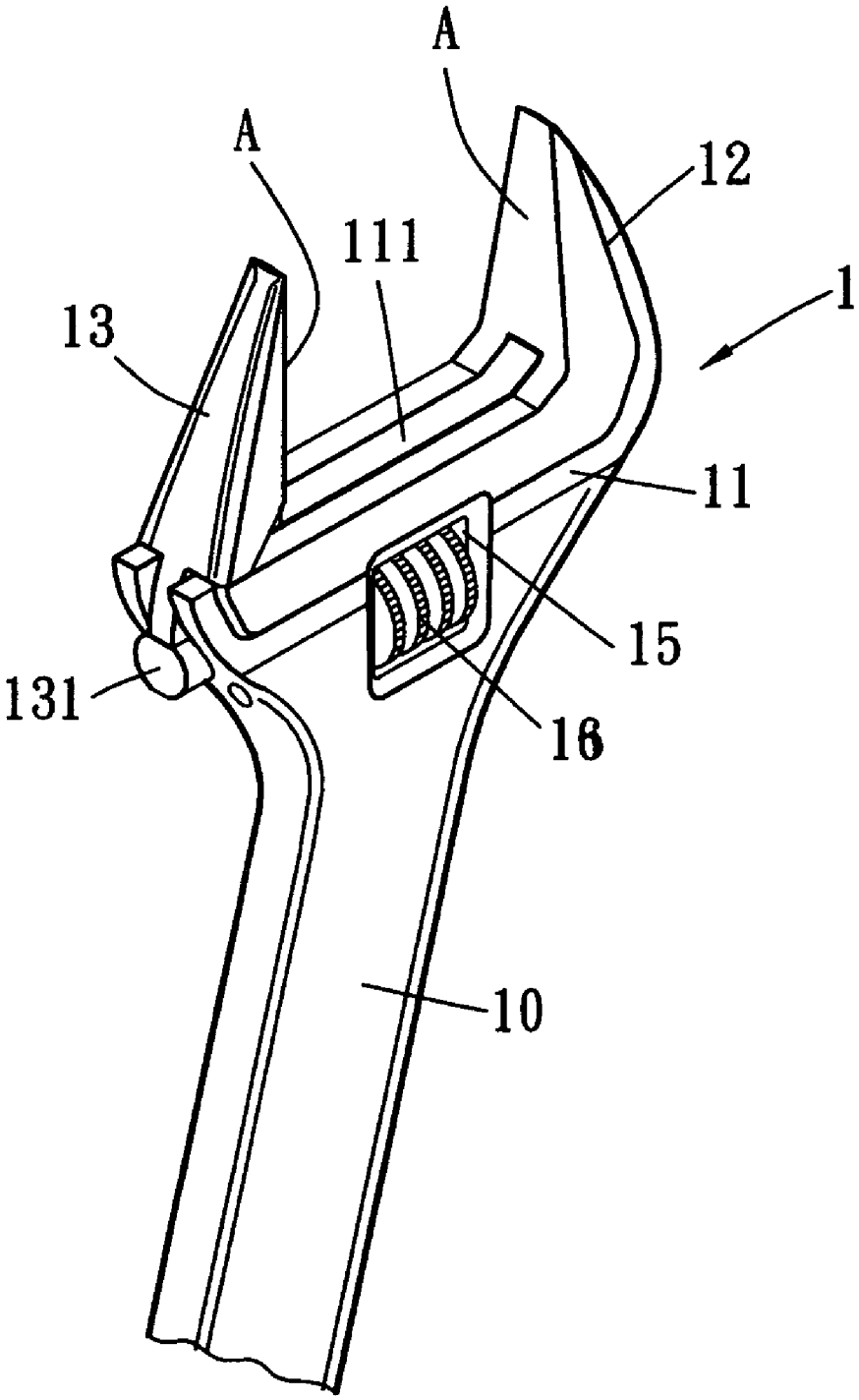
FIG. 1 is a perspective view of an adjustable wrench of the present invention.

Referring to FIG. 1, an adjustable wrench 1 according to the present invention comprising a handle 10, a head portion 11 formed at one end of the handle, and an adjusting unit 16. The head portion 11 further includes a fixed jaw 12 and a movable jaw 13; the fixed jaw 12 and the movable jaw 13 form a clip surface A for clipping a screwed par. The movable jaw 13 is provided with a slide rod 131 at the bottom side thereof that is retained along a slot 14 extended transversely across the head portion 11. The adjusting unit 16 controls the displacement of the movable jaw 13 along the slot 14, whereby the distance between the movable jaw 13 and the fixed jaw 12 can be freely adjusted.

Figure 2:
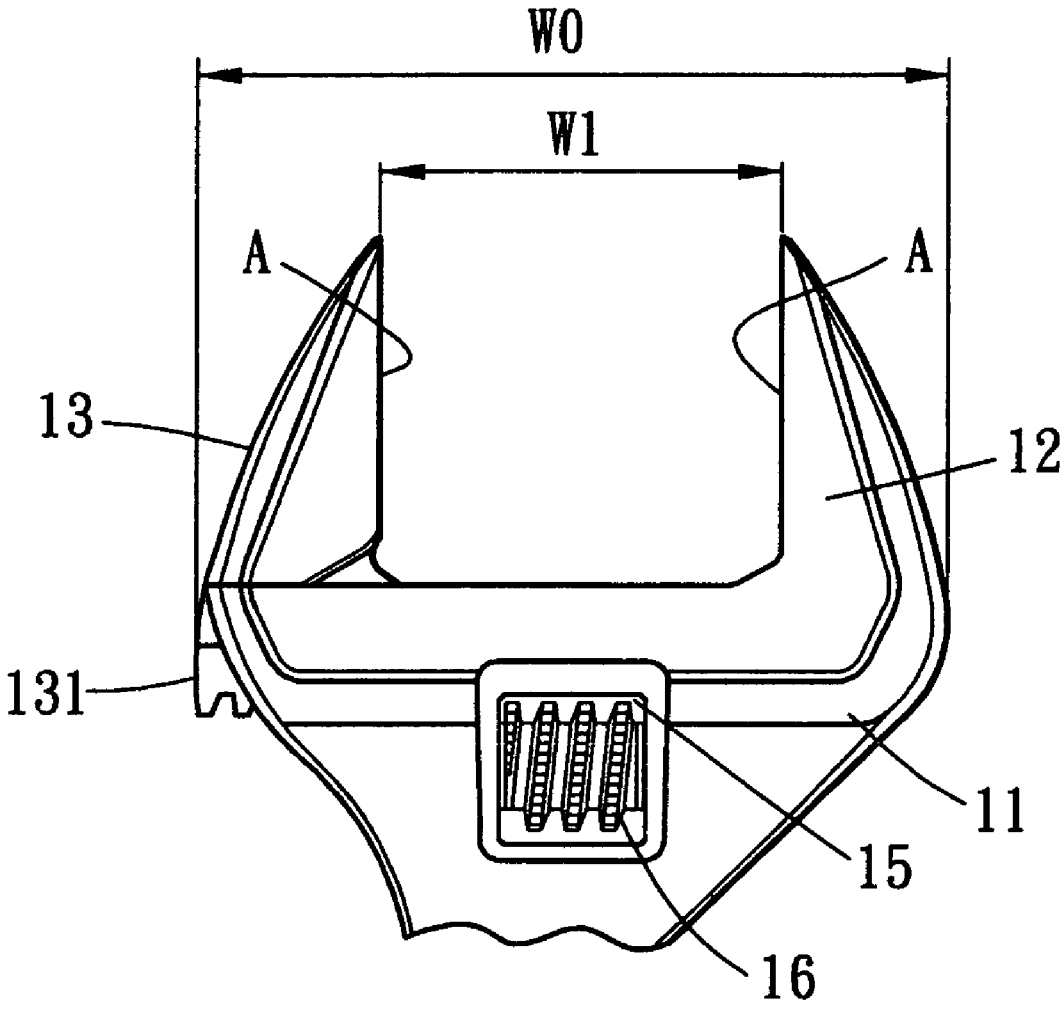
FIG. 2 is a side view of the head portion of the adjustable wrench in FIG. 1.

The main characteristic of the present invention is the ratio of the maximal outer width W0 of the clip surface to the maximal clip size W1 is specially and precisely designed, as shown in FIG. 2.

The maximal outer width W0 is specifically defined by the distance between two imaginary parallel planes both perpendicular to said slot and respectively tangent to the most bulged point on said outer lateral wall of said fixed jaw and the outermost end of said slide rod of said movable jaw.

The ratio of the maximal outer width W0 to the maximal inner width W1 is selected from three ranges: (1) less than or equal to 210% and greater than or equal to 150%; (2) less than or equal to 200% and greater than or equal to 150%; and (3) less than or equal to 175% and greater than or equal to 150%.

Figure 3:
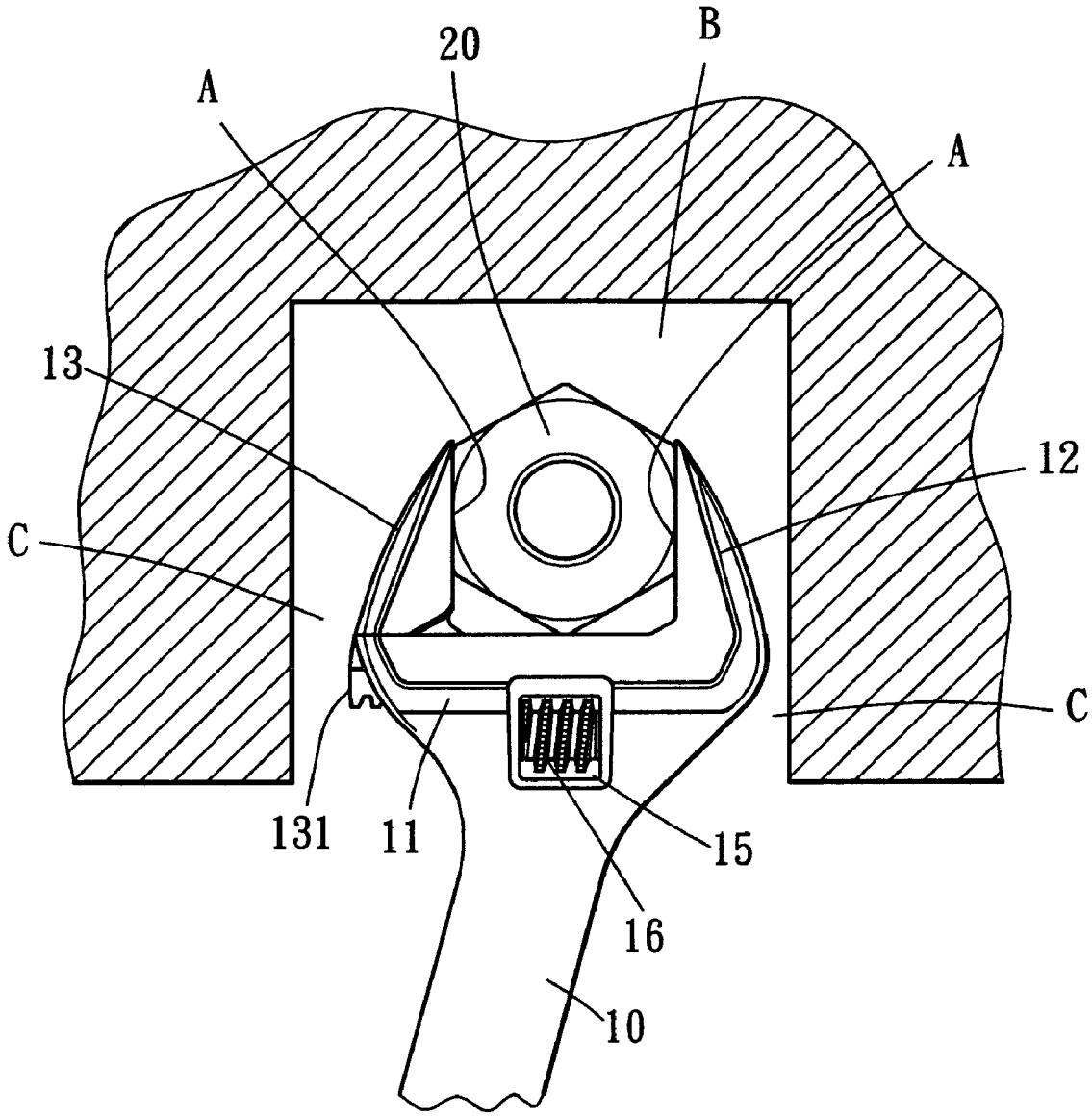
FIG. 3 is the adjustable wrench in FIG. 1, when inserted into a limited space.
Figure 4:
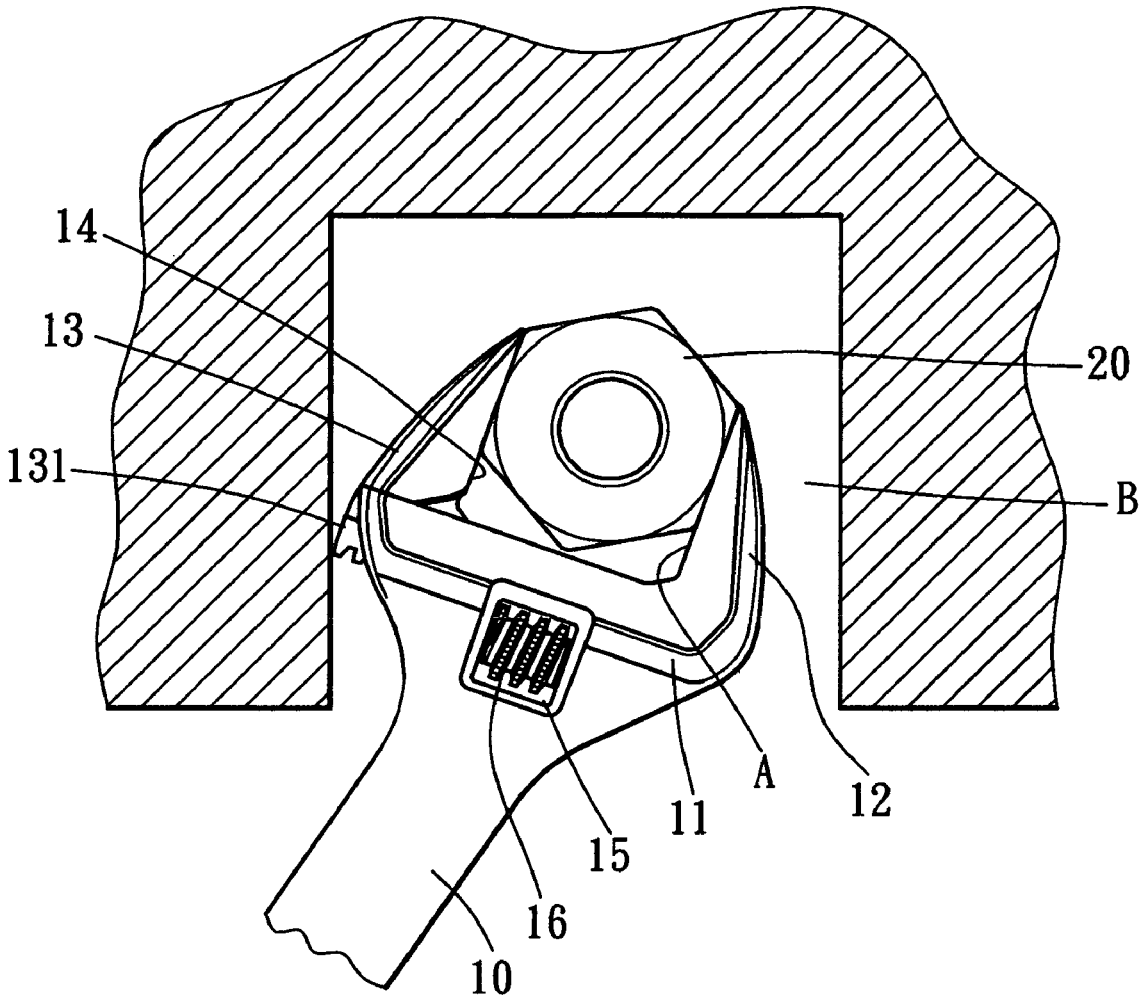
FIG. 4 illustrates the adjustable wrench in FIG. 1, being twisted in the limited space shown in FIG. 3.
Figure 5:
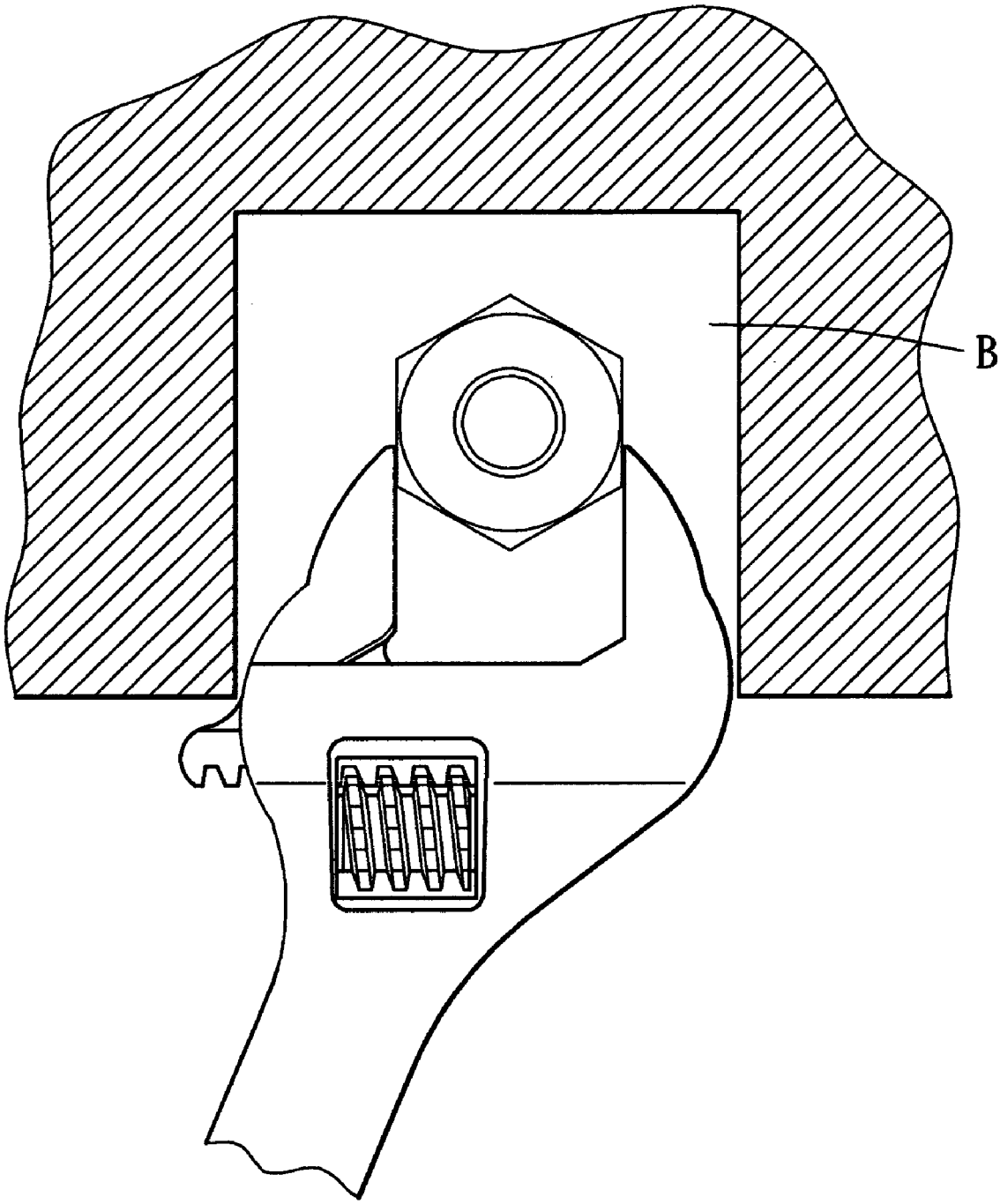
FIG. 5 shows that the adjustable wrench inserts into the limited space in FIGS. 3 and 4.

As shown in FIGS. 3 to 5, the advantage of the particularly designed ratio W0/W1 is that an adjustable wrench of the present invention can be used to clip a screwed part 20 inside a limited space B, leaving enough room for twisting around. On the other hand, when an adjustable wrench of the prior art is inserted into the limited space B, the slide rod of the movable jaw may bulge out too much, therefore hindering the rotation of the wrench around the screwed part 20. Further, the conventional wrench holds the screwed part 20 only partly, which is risky to a user and may damage the screwed part 20.

On the other hand, the ratio W0/W1 of the present invention, selected from 150%~210%, 150%~200%, and 150%~175%, facilitates the insertion of the head portion 11 of the adjustable wrench 1 into the limited space B. Even the wrench having the maximal clip size can be easily inserted and placed around the screwed part 20. Further, as the wrench is fastened around the screwed part 20, there exists sufficient room for operation C, as shown in FIGS. 3 and 4. Thereby, the angular range per twist is sufficiently increased. The screwed part 20 can be loosened quickly.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An adjustable wrench, comprising:

a handle;

a head portion formed at one end of said handle, said head portion further including a fixed jaw and a movable jaw, said fixed jaw and said movable jaw forming a clip surface for clipping a screwed part, said movable jaw being provided with a slide rod at a bottom side thereof that is retained along a slot extended transversely across said head portion; and an adjusting unit controlling the displacement of said movable jaw along said slot;

whereby the ratio of a maximal outer width defined by the distance between outer lateral walls of said fixed and movable jaws when they are most widely opened to a maximal inner width defined by the distance between inner facing walls of said fixed and movable jaws when they are most widely opened will be less than or equal to 210% and greater than or equal to 150%; and wherein said maximal outer width is defined by the distance between two imaginary parallel planes both perpendicular to said slot and respectively tangent to the most bulged point on said outer lateral wall of said fixed jaw and the outermost end of said slide rod of said movable jaw.

2. An adjustable wrench, comprising:

a handle;

a head portion formed at one end of said handle, said head portion further including a fixed jaw and a movable jaw, said fixed jaw and said movable jaw forming a clip surface for clipping a screwed part, said movable jaw being provided with a slide rod at a bottom side thereof that is retained along a slot extended transversely across said head portion; and an adjusting unit controlling the displacement of said movable jaw along said slot;

whereby the ratio of a maximal outer width defined by the distance between outer lateral walls of said fixed and movable jaws when they are most widely opened to a maximal inner width defined by the distance between inner facing walls of said fixed and movable jaws when they are most widely opened will be less than or equal to 200% and greater than or equal to 150%; and wherein said maximal outer width is defined by the distance between two imaginary parallel planes both perpendicular to said slot and respectively tangent to the most bulged point on said outer lateral wall of said fixed jaw and the outermost end of said slide rod of said movable jaw.

3. An adjustable wrench, comprising:

a handle;

a head portion formed at one end of said handle, said head portion further including a fixed jaw and a movable jaw, said fixed jaw and said movable jaw forming a clip surface for clipping a screwed part, said movable jaw being provided with a slide rod at a bottom side thereof that is retained along a slot extended transversely across said head portion; and an adjusting unit controlling the displacement of said movable jaw along said slot;

whereby the ratio of a maximal outer width defined by the distance between outer lateral walls of said fixed and movable jaws when they are most widely opened to a maximal inner width defined by the distance between inner facing walls of said fixed and movable jaws when they are most widely opened will be less than or equal to 175% and greater than or equal to 150%; and wherein said maximal outer width is defined by the distance between two imaginary parallel planes both perpendicular to said slot and respectively tangent to the most bulged point on said outer lateral wall of said fixed jaw and the outermost end of said slide rod of said movable jaw.

* * * * *